US009073658B2

(12) United States Patent
Spivey, Sr. et al.

(10) Patent No.: US 9,073,658 B2
(45) Date of Patent: Jul. 7, 2015

(54) CARTON WITH REINFORCED HANDLE

(71) Applicant: Graphic Packaging International, Inc., Atlanta, GA (US)

(72) Inventors: Raymond R. Spivey, Sr., Mableton, GA (US); Jean-Manuel Gomes, Acworth, GA (US); Colin P. Ford, Woodstock, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 208 days.

(21) Appl. No.: 13/778,518

(22) Filed: Feb. 27, 2013

(65) Prior Publication Data

US 2013/0221080 A1 Aug. 29, 2013

Related U.S. Application Data

(60) Provisional application No. 61/634,305, filed on Feb. 27, 2012.

(51) Int. Cl.
*B65D 5/46* (2006.01)
*B65D 5/00* (2006.01)
(Continued)

(52) U.S. Cl.
CPC ... *B65D 5/00* (2013.01); *B31B 1/26* (2013.01); *B65D 5/46096* (2013.01);
(Continued)

(58) Field of Classification Search
CPC ..... B65D 5/46168; B65D 5/4616; B65D 5/46176; B65D 5/46128; B65D 5/46144; B65D 5/46136; B65D 5/46096; B65D 5/46112; B65D 5/46104; B65D 71/36; B65D 2571/00481; B65D 2571/00512; B31B 1/26
USPC ..... 229/117.13, 117.14, 117.15, 162.1
See application file for complete search history.

(56) References Cited

U.S. PATENT DOCUMENTS 1,253,193 A 1/1918 Hill
1,624,439 A 4/1927 Senat
(Continued)

FOREIGN PATENT DOCUMENTS

CA 877792 8/1971
CA 2 160 145 9/1995
(Continued)

OTHER PUBLICATIONS

International Search Report and Written Opinion for PCT/US2013/027913 dated Jul. 1, 2013.
(Continued)

*Primary Examiner* — Gary Elkins
(74) *Attorney, Agent, or Firm* — Womble Carlyle Sandridge & Rice, LLP

(57) ABSTRACT

A carton for carrying a plurality of articles. The carton comprises a plurality of panels extending at least partially around an interior of the carton. The plurality of panels comprise at least a first top panel, a second top panel, at least one side panel, and a bottom panel. The first top panel and the second top panel are at least partially overlapped. At least one of the first top panel and the second top panel comprise a main portion foldably connected to the at least one side panel and a distal portion foldably connected to the main portion. The main portion has a first handle portion and the distal portion has a second handle portion. The distal portion has an exterior surface at least partially in face-to-face contact with the interior surface of the main portion. The carton further comprises a handle comprising at least the first handle portion and the second handle portion.

35 Claims, 11 Drawing Sheets

(51) Int. Cl.
*B31B 1/26* (2006.01)
*B65D 71/36* (2006.01)

(52) U.S. Cl.
CPC ..... *B65D 71/36* (2013.01); *B65D 2571/00141* (2013.01); *B65D 2571/00481* (2013.01); *B65D 2571/00512* (2013.01); *B65D 2571/00561* (2013.01); *B65D 2571/00654* (2013.01); *B65D 2571/00716* (2013.01); *B65D 2571/00728* (2013.01)

(56) References Cited

U.S. PATENT DOCUMENTS 2,111,621 A 3/1938 Gerking et al.
2,252,023 A * 8/1941 Mulnix ..... 229/117.15
2,268,906 A * 1/1942 Scheer ..... 229/117.15
2,383,183 A 8/1945 Fischer
2,575,654 A 11/1951 Casler
2,594,376 A 4/1952 Arneson
2,661,142 A 12/1953 Hendrickson, Jr.
2,663,485 A * 12/1953 Johnson ..... 229/117.15
2,694,518 A 11/1954 Zanck et al.
2,702,144 A 2/1955 Forrer
2,737,326 A 3/1956 Toensmeier
2,764,284 A 9/1956 Arneson
2,797,856 A 7/1957 Jaeschke
2,810,506 A 10/1957 Kessler
2,868,433 A 1/1959 Anderson, Jr.
2,911,136 A 11/1959 Stone
2,950,041 A 8/1960 Stone
2,955,739 A 10/1960 Collura
2,975,934 A 3/1961 Powell
2,990,997 A 7/1961 Weiss
3,112,856 A 12/1963 MacIntosh et al.
3,127,720 A 4/1964 Gentry et al.
3,167,214 A 1/1965 Mahon
3,198,378 A 8/1965 Farquhar
3,204,815 A 9/1965 Weiss
3,245,711 A 4/1966 Dantoin
3,309,005 A 3/1967 Pilger
3,313,406 A 4/1967 Outwater
3,334,767 A 8/1967 Cornelius et al.
3,355,012 A 11/1967 Weiss
3,381,881 A 5/1968 Granz et al.
3,534,899 A 10/1970 Hoshi et al.
3,612,266 A 10/1971 Graser
3,722,945 A 3/1973 Wood
3,747,835 A 7/1973 Graser
3,767,041 A 10/1973 Graser
3,790,066 A * 2/1974 Malinowski ..... 229/117.13
3,828,926 A 8/1974 Rossi
3,860,281 A 1/1975 Wood
3,886,901 A 6/1975 Zeitler
3,904,036 A 9/1975 Forrer
3,933,303 A 1/1976 Kirby, Jr.
3,942,631 A 3/1976 Sutherland et al.
3,994,432 A 11/1976 Kirby, Jr.
4,029,204 A 6/1977 Manizza
4,032,053 A 6/1977 Wilson
4,034,852 A 7/1977 Forrer
4,036,423 A 7/1977 Gordon
4,096,985 A 6/1978 Wood
4,111,306 A 9/1978 Roccaforte
4,140,267 A 2/1979 Scott et al.
4,164,286 A 8/1979 Sutherland
4,171,763 A 10/1979 Card
4,180,191 A 12/1979 Wood
4,188,766 A 2/1980 Culpepper
4,192,540 A 3/1980 Oliff
4,202,446 A 5/1980 Sutherland
4,216,861 A 8/1980 Oliff
4,244,617 A 1/1981 Manizza
4,308,995 A 1/1982 Hanes
4,311,268 A 1/1982 Soliven
4,318,474 A 3/1982 Hasegawa
4,318,476 A 3/1982 Wood et al.
4,326,628 A 4/1982 Wood
4,329,923 A 5/1982 Iida
4,331,289 A * 5/1982 Killy ..... 229/117.13
4,336,898 A 6/1982 Joyce
4,364,509 A 12/1982 Holley et al.
4,375,258 A 3/1983 Crayne et al.
4,378,905 A 4/1983 Roccaforte
4,382,505 A 5/1983 Sutherland et al.
4,386,699 A 6/1983 Sutherland
4,415,082 A 11/1983 Martin
4,424,901 A 1/1984 Lanier
4,432,579 A 2/1984 Denmark et al.
4,438,843 A 3/1984 Graser
4,440,340 A 4/1984 Bakx
4,478,334 A 10/1984 Graser
4,482,090 A 11/1984 Milliens
4,498,619 A 2/1985 Roccaforte
4,508,258 A 4/1985 Graser
4,538,759 A 9/1985 Dutcher
4,545,485 A 10/1985 Oliff
4,546,914 A 10/1985 Roccaforte
4,566,591 A 1/1986 Turtschan et al.
4,566,593 A 1/1986 Muller
4,582,199 A 4/1986 Schuster
4,588,084 A 5/1986 Holley, Jr.
4,653,686 A 3/1987 Wood et al.
4,681,217 A 7/1987 Hernandez
4,700,831 A * 10/1987 Kassai ..... 229/162.1
4,706,876 A 11/1987 Wilson
4,747,487 A 5/1988 Wood
4,784,266 A 11/1988 Chaussadas
4,784,316 A 11/1988 Crouch
4,785,991 A 11/1988 Schuster
4,802,583 A 2/1989 Calvert et al.
4,830,267 A 5/1989 Wilson
4,875,586 A 10/1989 Chaussadas
4,925,019 A 5/1990 Ganz et al.
4,941,624 A 7/1990 Schuster
4,966,324 A 10/1990 Steel
5,002,186 A 3/1991 Cooper
5,020,337 A 6/1991 Krieg
5,060,792 A 10/1991 Oliff
5,060,804 A 10/1991 Beales et al.
5,094,359 A 3/1992 DeMars et al.
5,106,014 A 4/1992 Miller
5,119,985 A 6/1992 Dawson et al.
5,135,104 A 8/1992 Jorba
5,139,147 A 8/1992 Sutherland
5,167,325 A 12/1992 Sykora
5,188,225 A 2/1993 Jorba
5,197,598 A 3/1993 Stout et al.
5,221,041 A 6/1993 Stout et al.
5,221,042 A 6/1993 Oliff
5,222,658 A 6/1993 DeMaio et al.
5,234,102 A 8/1993 Schuster et al.
5,246,112 A 9/1993 Stout et al.
5,273,156 A 12/1993 Harris
5,284,294 A 2/1994 Floyd
5,292,058 A 3/1994 Zoss et al.
5,292,059 A 3/1994 Oliff
5,297,673 A 3/1994 Sutherland
5,297,725 A 3/1994 Sutherland
5,303,863 A 4/1994 Arasim
5,307,932 A 5/1994 Stout et al.
5,307,986 A 5/1994 Schuster
5,310,050 A 5/1994 Sutherland
5,310,051 A 5/1994 Sutherland
5,320,277 A 6/1994 Stout et al.
5,323,895 A 6/1994 Sutherland et al.
5,328,024 A 7/1994 Sutherland
5,333,734 A 8/1994 Stout et al.
5,344,006 A 9/1994 Mazzeo
5,351,815 A 10/1994 Fogle et al.
5,351,816 A 10/1994 Sutherland et al.
5,351,817 A 10/1994 Sutherland
5,355,999 A 10/1994 Sutherland
5,360,104 A 11/1994 Sutherland
5,363,954 A 11/1994 Dampier

(56) References Cited

U.S. PATENT DOCUMENTS

| | | | | |
|---|---|---|---|---|
| 5,379,944 | A | 1/1995 | Stout et al. | |
| 5,381,891 | A | 1/1995 | Harris | |
| 5,385,234 | A | 1/1995 | Stout et al. | |
| 5,390,784 | A | 2/1995 | Sutherland | |
| 5,395,044 | A | 3/1995 | Stout | |
| 5,407,065 | A | 4/1995 | Sutherland | |
| 5,415,278 | A | 5/1995 | Sutherland | |
| 5,427,241 | A | 6/1995 | Sutherland | |
| 5,443,153 | A | 8/1995 | Sutherland | |
| 5,445,262 | A | 8/1995 | Sutherland | |
| 5,452,799 | A | 9/1995 | Sutherland | |
| 5,458,234 | A | 10/1995 | Harris | |
| 5,472,090 | A | 12/1995 | Sutherland | |
| 5,474,172 | A | 12/1995 | Zavatone et al. | |
| 5,484,059 | A | 1/1996 | Sutherland | |
| 5,485,915 | A | 1/1996 | Harris | |
| 5,495,727 | A | 3/1996 | Strong et al. | |
| 5,501,335 | A | 3/1996 | Harris | |
| 5,503,267 | A | 4/1996 | Sutherland | |
| 5,505,304 | A | 4/1996 | Broskow et al. | |
| 5,520,283 | A | 5/1996 | Sutherland | |
| 5,524,756 | A | 6/1996 | Sutherland | |
| 5,551,556 | A | 9/1996 | Sutherland | |
| 5,582,289 | A | 12/1996 | Wright | |
| 5,582,343 | A | 12/1996 | Dalvey | |
| 5,593,027 | A | 1/1997 | Sutherland | |
| 5,598,920 | A | 2/1997 | Hansen | |
| 5,605,228 | A | 2/1997 | Baxter | |
| 5,609,251 | A | 3/1997 | Harris | |
| 5,638,956 | A | 6/1997 | Sutherland | |
| 5,639,017 | A | 6/1997 | Fogle | |
| 5,647,483 | A | 7/1997 | Harris | |
| 5,669,500 | A | 9/1997 | Sutherland | |
| 5,687,838 | A | 11/1997 | Bakx | |
| 5,699,957 | A | 12/1997 | Blin et al. | |
| 5,704,470 | A | 1/1998 | Sutherland | |
| 5,735,394 | A | 4/1998 | Harrelson | |
| 5,738,217 | A | 4/1998 | Hunter | |
| 5,738,273 | A * | 4/1998 | Auclair | 229/117.13 |
| 5,746,310 | A | 5/1998 | Slomski | |
| 5,794,778 | A | 8/1998 | Harris | |
| 5,816,391 | A | 10/1998 | Harris | |
| 5,820,185 | A | 10/1998 | Gomes | |
| 5,826,782 | A | 10/1998 | Stout | |
| 5,845,776 | A | 12/1998 | Galbierz et al. | |
| 5,871,090 | A | 2/1999 | Doucette et al. | |
| 5,873,515 | A | 2/1999 | Dunn et al. | |
| 5,878,876 | A | 3/1999 | Galbierz et al. | |
| 5,878,946 | A | 3/1999 | Frerot et al. | |
| 5,915,546 | A | 6/1999 | Harrelson | |
| 5,960,945 | A | 10/1999 | Sutherland | |
| 5,979,747 | A | 11/1999 | Gnadt et al. | |
| 5,984,086 | A | 11/1999 | Foushee et al. | |
| 5,992,733 | A | 11/1999 | Gomes | |
| D420,575 | S | 2/2000 | Rovere | |
| 6,019,276 | A | 2/2000 | Auclair | |
| 6,021,897 | A | 2/2000 | Sutherland | |
| 6,065,590 | A | 5/2000 | Spivey | |
| 6,070,790 | A * | 6/2000 | Anderson | 229/136 |
| 6,085,969 | A | 7/2000 | Burgoyne | |
| 6,105,853 | A | 8/2000 | Lamare | |
| 6,105,854 | A | 8/2000 | Spivey et al. | |
| 6,112,977 | A | 9/2000 | Sutherland et al. | |
| 6,131,803 | A | 10/2000 | Oliff et al. | |
| 6,164,526 | A | 12/2000 | Dalvey | |
| 6,170,741 | B1 | 1/2001 | Skolik et al. | |
| 6,223,891 | B1 | 5/2001 | Devens et al. | |
| 6,223,892 | B1 | 5/2001 | Bakx | |
| 6,227,367 | B1 | 5/2001 | Harrelson et al. | |
| 6,260,755 | B1 | 7/2001 | Bates et al. | |
| 6,302,320 | B1 | 10/2001 | Stout | |
| 6,315,111 | B1 | 11/2001 | Sutherland | |
| D452,154 | S | 12/2001 | Rhodes et al. | |
| 6,425,520 | B1 * | 7/2002 | Peterson | 229/117.13 |
| 6,484,903 | B2 | 11/2002 | Spivey et al. | |
| 6,488,322 | B2 | 12/2002 | Bakx | |
| 6,502,743 | B2 | 1/2003 | Ikeda | |
| 6,523,739 | B2 | 2/2003 | Heeley et al. | |
| 6,615,984 | B2 | 9/2003 | Saulas et al. | |
| 6,631,803 | B2 | 10/2003 | Rhodes et al. | |
| 6,758,337 | B2 | 7/2004 | Chargueraud et al. | |
| 6,779,655 | B2 | 8/2004 | Olsen et al. | |
| 6,834,793 | B2 | 12/2004 | Sutherland | |
| 6,848,573 | B2 | 2/2005 | Gould et al. | |
| 6,869,009 | B2 | 3/2005 | Sutherland et al. | |
| 6,896,130 | B2 | 5/2005 | Theelen | |
| 6,899,221 | B2 | 5/2005 | Skolik et al. | |
| 6,905,066 | B2 | 6/2005 | Holley et al. | |
| 6,926,193 | B2 | 8/2005 | Smalley | |
| 6,945,450 | B2 | 9/2005 | Rusnock | |
| 6,981,631 | B2 | 1/2006 | Fogle et al. | |
| 7,011,209 | B2 | 3/2006 | Sutherland et al. | |
| 7,234,596 | B2 | 6/2007 | Lebras | |
| 7,264,114 | B2 | 9/2007 | Daniel | |
| 7,296,731 | B2 | 11/2007 | Auclair et al. | |
| 7,380,701 | B2 | 6/2008 | Fogle et al. | |
| 7,416,109 | B2 | 8/2008 | Sutherland | |
| 7,427,010 | B2 | 9/2008 | Sutherland | |
| 7,472,791 | B2 | 1/2009 | Spivey, Sr. | |
| 7,601,111 | B2 | 10/2009 | Sutherland et al. | |
| 7,699,215 | B2 | 4/2010 | Spivey, Sr. | |
| 7,743,944 | B2 | 6/2010 | Ho Fung et al. | |
| 7,743,969 | B2 | 6/2010 | Bokel | |
| 7,748,603 | B2 | 7/2010 | Fogle et al. | |
| 7,757,933 | B2 | 7/2010 | Dunn | |
| 7,806,314 | B2 | 10/2010 | Sutherland | |
| 8,070,052 | B2 | 12/2011 | Spivey, Sr. et al. | |
| 8,216,118 | B2 | 7/2012 | Dunn | |
| 8,256,617 | B2 | 9/2012 | Gomes et al. | |
| 8,453,918 | B2 | 6/2013 | Hsiao et al. | |
| 8,469,184 | B2 | 6/2013 | Spivey, Sr. | |
| 8,511,463 | B2 | 8/2013 | Brand | |
| 2002/0195371 | A1 | 12/2002 | Brown | |
| 2003/0080004 | A1 | 5/2003 | Olsen et al. | |
| 2003/0111362 | A1 | 6/2003 | Sutherland et al. | |
| 2003/0213263 | A1 | 11/2003 | Woog | |
| 2003/0213705 | A1 | 11/2003 | Woog | |
| 2004/0074954 | A1 | 4/2004 | Fogle et al. | |
| 2004/0079666 | A1 | 4/2004 | Bakx | |
| 2004/0226833 | A1 | 11/2004 | Daniel | |
| 2005/0056658 | A1 | 3/2005 | Spivey | |
| 2005/0167478 | A1 | 8/2005 | Holley. Jr. | |
| 2006/0071058 | A1 | 4/2006 | Spivey, Sr. | |
| 2006/0169755 | A1 | 8/2006 | Spivey, Sr. | |
| 2006/0266812 | A1 * | 11/2006 | Von Bokel | 229/117.14 |
| 2006/0273143 | A1 | 12/2006 | Finch | |
| 2007/0029371 | A1 | 2/2007 | Theelen | |
| 2007/0039846 | A1 | 2/2007 | Spivey, Sr. | |
| 2007/0051781 | A1 | 3/2007 | Holley, Jr. | |
| 2007/0108261 | A1 | 5/2007 | Schuster | |
| 2007/0164091 | A1 | 7/2007 | Fogle et al. | |
| 2007/0181658 | A1 | 8/2007 | Sutherland | |
| 2007/0205255 | A1 | 9/2007 | Dunn | |
| 2007/0284424 | A1 | 12/2007 | Holley | |
| 2007/0295789 | A1 | 12/2007 | Ho Fung | |
| 2008/0083820 | A1 | 4/2008 | Walling et al. | |
| 2008/0119344 | A1 | 5/2008 | Sutherland et al. | |
| 2009/0236408 | A1 * | 9/2009 | Spivey et al. | 229/117.13 |
| 2009/0255983 | A1 | 10/2009 | De Paula et al. | |
| 2010/0089987 | A1 | 4/2010 | Brandinelli | |
| 2010/0213249 | A1 | 8/2010 | Requena | |
| 2010/0270367 | A1 | 10/2010 | Brandenburger | |
| 2010/0320098 | A1 | 12/2010 | Brand | |
| 2011/0048975 | A1 | 3/2011 | Brand | |
| 2012/0104079 | A1 | 5/2012 | Wagner | |

FOREIGN PATENT DOCUMENTS

| | | |
|---|---|---|
| DE | 9308141.3 U1 | 9/1961 |
| DE | 85 14 718.4 | 6/1985 |
| DE | 296 07 374 | 4/1996 |
| DE | 196 42 571 A1 | 5/1997 |
| DE | 201 12 228 | 11/2002 |
| DE | 203 17 334 U1 | 2/2004 |

(56) References Cited

FOREIGN PATENT DOCUMENTS

| | | | |
|---|---|---|---|
| DE | 20 2004 004 248 | U1 | 8/2004 |
| DE | 20 2004 017 954 | U1 | 2/2005 |
| DE | 20 2004 018 649 | | 4/2005 |
| EP | 0 048 506 | | 3/1982 |
| EP | 0 285 043 | A1 | 10/1988 |
| EP | 0 398 835 | B1 | 11/1990 |
| EP | 0 412 226 | | 2/1991 |
| EP | 0 473 266 | | 3/1992 |
| EP | 0 495 197 | A1 | 7/1992 |
| EP | 0 541 334 | A1 | 5/1993 |
| EP | 0 780 320 | A1 | 6/1997 |
| EP | 1 070 671 | A1 | 1/2001 |
| EP | 1 384 679 | A1 | 1/2004 |
| EP | 1 612 157 | | 1/2006 |
| FR | 1274610 | | 9/1961 |
| FR | 1 494 239 | | 9/1967 |
| FR | 1 582 235 | | 9/1969 |
| FR | 2 525 992 | | 11/1983 |
| FR | 2 579 175 | | 9/1986 |
| FR | 2634456 | | 1/1990 |
| FR | 2 664 239 | | 1/1992 |
| FR | 2 731 413 | | 9/1996 |
| GB | 1 342 180 | | 12/1973 |
| GB | 2 085 391 | A | 4/1982 |
| GB | 2 158 037 | A | 11/1985 |
| JP | 05-147643 | A | 6/1993 |
| JP | 8-507486 | | 8/1996 |
| JP | 2003-146359 | | 5/2003 |
| JP | 2003-300554 | | 10/2003 |
| JP | 38-17186 | | 8/2006 |
| KR | 20-0356729 | | 7/2004 |
| WO | WO 95/02546 | | 1/1995 |
| WO | WO 96/27538 | | 9/1996 |
| WO | WO 97/33807 | | 9/1997 |
| WO | WO 98/49071 | | 11/1998 |
| WO | WO 99/01356 | | 1/1999 |
| WO | WO 99/28207 | | 6/1999 |
| WO | WO 00/78618 | | 12/2000 |
| WO | WO 01/66434 | | 9/2001 |
| WO | WO 02/059011 | A2 | 8/2002 |
| WO | WO 02/062676 | A1 | 8/2002 |
| WO | WO 02/079048 | A1 | 10/2002 |
| WO | WO 03/016167 | A1 | 2/2003 |
| WO | WO 03/037742 | | 5/2003 |
| WO | WO 2005/080218 | | 9/2005 |
| WO | WO 2005/095222 | A1 | 10/2005 |
| WO | WO 2005/123532 | | 12/2005 |
| WO | WO 2006/044583 | A2 | 4/2006 |
| WO | WO 2006/108098 | A1 | 10/2006 |
| WO | WO 2007/044525 | A1 | 4/2007 |
| WO | WO 2007/089282 | | 8/2007 |
| WO | WO 2009-117562 | A1 | 9/2009 |

OTHER PUBLICATIONS

International Search Report and Written Opinion for PCT/US2014/015526 dated Nov. 19, 2014.

* cited by examiner

CARTON WITH REINFORCED HANDLE

CROSS-REFERENCE TO RELATED APPLICATIONS

This application claims the benefit of U.S. Provisional Patent Application No. 61/634,305 filed Feb. 27, 2012.

INCORPORATION BY REFERENCE

The disclosure of U.S. Provisional Patent Application No. 61/634,305, which was filed on Feb. 27, 2012, is hereby incorporated by reference for all purposes as if presented herein in their entirety.

BACKGROUND OF THE DISCLOSURE

The present disclosure generally relates to cartons or carriers for holding beverage containers or other types of articles.

SUMMARY OF THE DISCLOSURE

In general, one aspect of the disclosure is directed to a carton for carrying a plurality of articles. The carton comprises a plurality of panels extending at least partially around an interior of the carton. The plurality of panels comprise at least a first top panel, a second top panel, at least one side panel, and a bottom panel. The first top panel and the second top panel are at least partially overlapped. At least one of the first top panel and the second top panel comprise a main portion foldably connected to the at least one side panel and a distal portion foldably connected to the main portion. The main portion has a first handle portion and the distal portion has a second handle portion. The distal portion has an exterior surface at least partially in face-to-face contact with the interior surface of the main portion. The carton further comprises a handle comprising at least the first handle portion and the second handle portion.

In another aspect, the disclosure is generally directed to a blank for forming a carton for carrying a plurality of articles. The blank comprises a plurality of panels comprising at least a first top panel, a second top panel, at least one side panel, and a bottom panel, the first top panel and the second top panel are configured to be at least partially overlapped. At least one of the first top panel and the second top panel comprises a main portion foldably connected to the at least one side panel and a distal portion foldably connected to the main portion. The main portion has a first handle portion and the distal portion has a second handle portion. The distal portion has an exterior surface configured to be at least partially in face-to-face contact with the interior surface of the main portion. Features for forming a handle comprise at least the first handle portion and the second handle portion.

In another aspect, the disclosure is generally directed to a method of forming a carton for carrying a plurality of articles. The method comprises obtaining a blank comprising a plurality of panels comprising at least a first top panel, a second top panel, at least one side panel, and a bottom panel. The first top panel and the second top panel are configured to be at least partially overlapped. At least one of the first top panel and the second top panel comprises a main portion foldably connected to the at least one side panel and a distal portion foldably connected to the main portion. The main portion has a first handle portion and the distal portion has a second handle portion. The distal portion has an exterior surface configured to be at least partially in face-to-face contact with the interior surface of the main portion. Features for forming a handle comprise at least the first handle portion and the second handle portion. The method comprises forming at least a portion of an interior of the carton by folding the plurality of panels about the plurality of articles, and forming the handle by positioning the distal portion so that the exterior surface of the distal portion is in face-to-face contact with the interior surface of the main portion. The positioning the distal portion comprises positioning the first handle portion relative to the second handle portion to form the handle.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to various features for cartons, cartons, packages, containers, etc., that contain articles such as containers, bottles, cans, boxes, etc. The articles can be used for packaging food and beverage products, for example. The articles can be made from materials suitable in composition for packaging the particular food or beverage item, and the materials include, but are not limited to, paperboard, composite paperboard and plastic, aluminum and/or other metals; glass; plastics such as PET, LDPE, LLDPE, HDPE, PP, PS, PVC, EVOH, and Nylon; and the like, or any combination thereof.

Cartons or carriers according to the present disclosure can accommodate articles of any shape. For the purpose of illustration and not for the purpose of limiting the scope of the disclosure, the following detailed description describes beverage containers (e.g., brick-shaped containers) as disposed within the carton embodiments. In this specification, the terms "lower," "bottom," "upper" and "top" indicate orientations determined in relation to fully erected and upright cartons.

Figure 1:
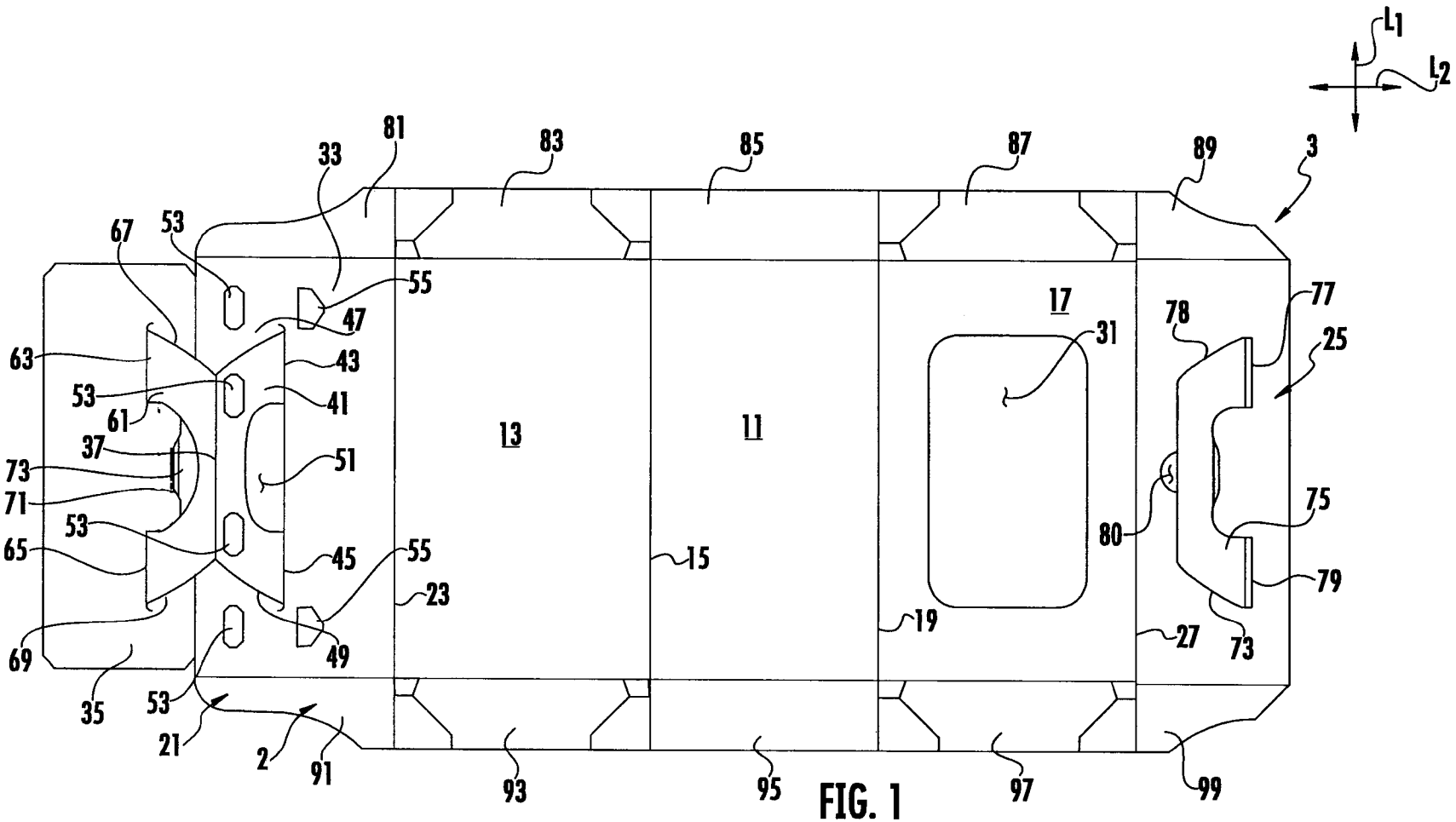
FIG. 1 is a plan view of an exterior surface of a blank of a first embodiment.

FIG. 1 is a plan view of an exterior surface 2 of a blank 3, used to form a carton 5, shown in FIGS. 5-9, according to one embodiment of the disclosure. The carton 5 can be used to house a plurality of articles such as containers C. In one embodiment, the containers C can be brick-shaped containers commonly referred to as TETRA PAK© containers that contain a liquid beverage or other food or beverage product. The containers C can be any suitable container such as any shape, size, and type of container that is commercially available from Tetra Pak International SA, Lausanne, Switzerland, such as TETRA BRIK packages, TETRA BRIK ASEPTIC packages, TETRA PRISM ASEPTIC packages, or any other suitable package or container (see www.tetrapak.com for more information). The containers C could be other suitable containers made from other materials by other manufactures (e.g., PET bottles, yogurt containers, juice-boxes, beverage cans, etc.) without departing form the disclosure.

In one embodiment, the blank 3 is sized to form a carton 5 that contains twelve containers C or packages in a single layer in a 3×4 arrangement. But, it is understood that the blank 3 and/or carton 5 may be sized and shaped to hold containers C of a different or same quantity in more than one layer and/or in different row/column arrangements (e.g., 1×6, 2×3, 2×6, 2×4, 2×2, 2×6×2, 2×4×2, 2×9, etc.). In the illustrated embodiment, the carton 5 has at least partially open ends 6, 8 and generally wraps around the containers C contacting the top and bottom of the group of containers. In one embodiment, the carton 5 may be referred to as a "wrap-around carton or carrier". Alternatively, the carton 5 could be a carton with ends that are closed by one or more end flaps with the containers being loaded into the partially formed carton prior to closing one or more ends of the carton without departing from the disclosure.

The carton 5 has a reinforced handle 7 that is used for grasping and carrying the carton. The handle 7 is formed by multiple layers of material of the blank 3 so that the handle is strengthened to reduce handle failure. For example, according to one embodiment, the handle 7 comprises two or more layers of material. According to another embodiment, the handle 7 comprises three layers of material.

As shown in FIG. 1, the blank 3 has a longitudinal axis L1 and a lateral axis L2. In the illustrated embodiment, the blank 3 comprises a bottom panel 11 foldably connected to a first side panel 13 at a lateral fold line 15, a second side panel 17 foldably connected to the bottom panel at a lateral fold line 19, a first top panel 21 foldably connected to the first side panel at a lateral fold line 23, and a second top panel 25 foldably connected to the second side panel 17 at a lateral fold line 27.

In one embodiment, the second side panel 17 includes an opening or window 31. The first top panel 21 includes a main portion 33 foldably connected to the first side panel 13 at the fold line 23 and a distal portion 35 foldably connected to the main portion by a lateral fold line 37. The main portion 33 has a first handle portion 41 foldably connected to the main portion at lateral fold lines 43, 45 and at least partially defined by tear lines 47, 49. An elongate handle opening 51 is adjacent the first handle portion 41 in the main portion 33 of the first top panel 21. The main portion 33 of the first top panel 21 has a first plurality of openings 53 that are generally aligned in the longitudinal direction L1 and are spaced apart in the longitudinal direction L1, and a second plurality of openings 55 that are generally aligned in the longitudinal direction and are spaced apart in the longitudinal direction. As will be discussed later below, the openings 53, 55 allow glue to pass through the main portion 33 of the first top panel 21 to a panel located below the main portion to facilitate forming of strengthening features of the handle 7.

In the first embodiment, the distal portion 35 includes a second handle portion 61 foldably connected to the first handle portion 41 at the lateral fold line 37. The second handle portion 61 is foldably connected to the distal portion 35 are lateral fold lines 63, 65 and is at least partially defined by arcuate cuts 67, 69 extending from a respective tear line 47, 49 to a respective fold line 63, 65. Also, the second handle portion 61 is defined by a curved cut 71 extending between a central portion of the second handle portion and defining a comfort flap 73 adjacent to the second handle portion.

As shown in FIG. 1, the second top panel 25 includes a third handle portion 75 foldably connected to the second top panel at two lateral fold lines 76, 77. The third handle portion 75 is at least partially defined by tear lines 78, 79 and an opening 80 is adjacent to the third handle portion. The first handle portion 41, second handle portion 61, and third handle portion 75 combine to form the handle 7 in a manner that will be described in further detail below. One or more of the handle portions 41, 61, 75 could be otherwise shaped, arranged, and/or omitted without departing form the disclosure.

In one embodiment, the panels 11, 13, 17, 21, 25 have respective first end flaps 81, 83, 85, 87, 89 at a first marginal portion of the blank 3 such that the first end flaps are foldably connected to respective panels by a longitudinal fold line 90. The panels 11, 13, 17, 21, 25 have respective second end flaps 91, 93, 95, 97, 99 at a second marginal portion of the blank 3 such that the second end flaps are foldably connected to respective panels by a longitudinal fold line 100. The first end flaps 81, 83, 85, 87, 89 are for closing the first end 6 of the carton 5 and the second end flaps 91, 93, 95, 97, 99 are for closing the second end 8 of the carton. One or more of the first end flaps 81, 83, 85, 87, 89 and second end flaps 91, 93, 95, 97, 99 can be foldably connected to each other at respective fold lines, or one or more of the end flaps can have respective gussets or webs foldably connecting adjacent first or second end flaps or one or more of the end flaps can be tuck-in panels or flaps without departing from the disclosure. The end flaps could be otherwise shaped, arranged, configured, and/or omitted without departing from the disclosure.

Figure 2:
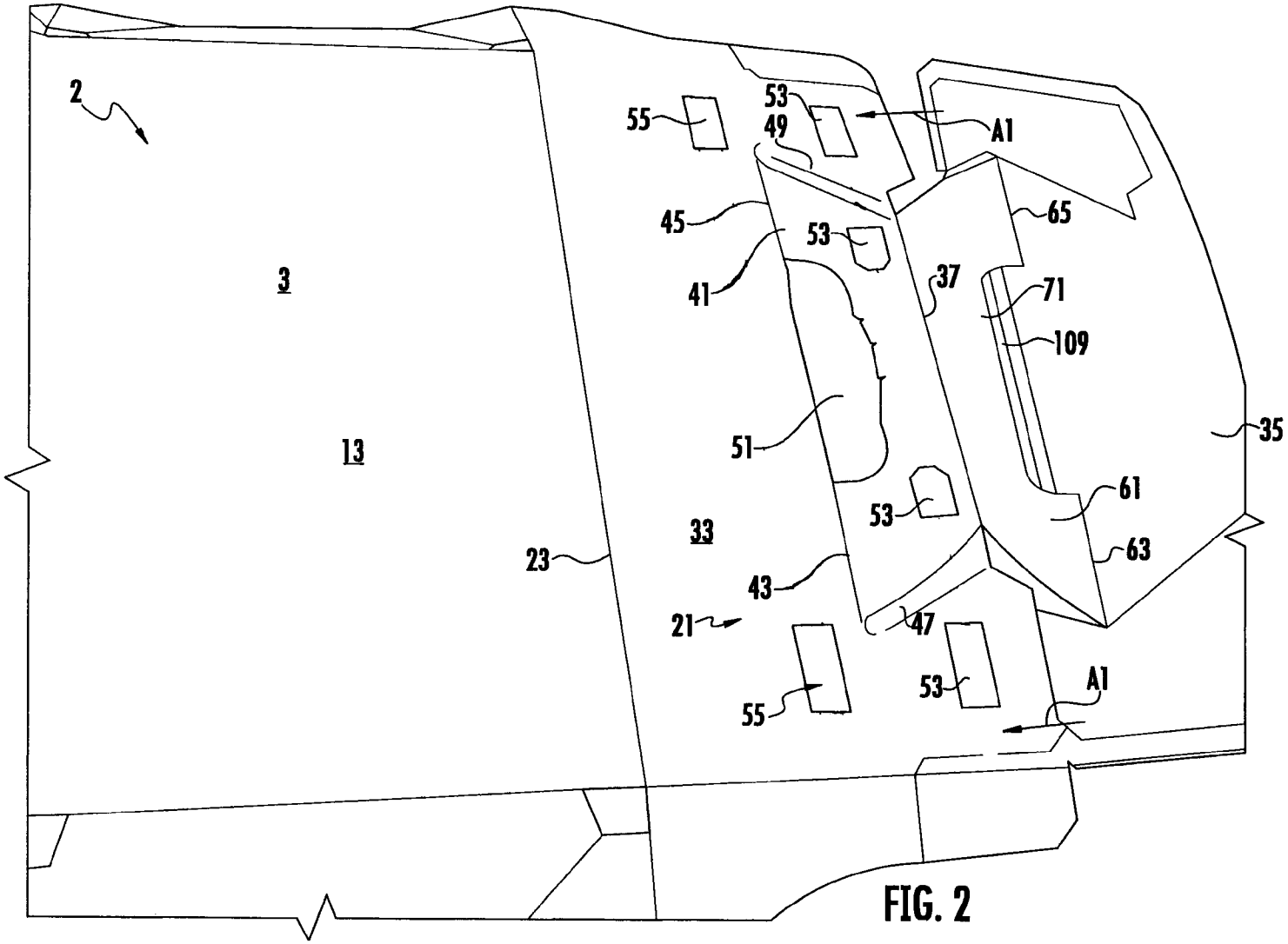
FIG. 2 is an expanded view of a handle-forming portion of the blank of FIG. 1.
Figure 3:
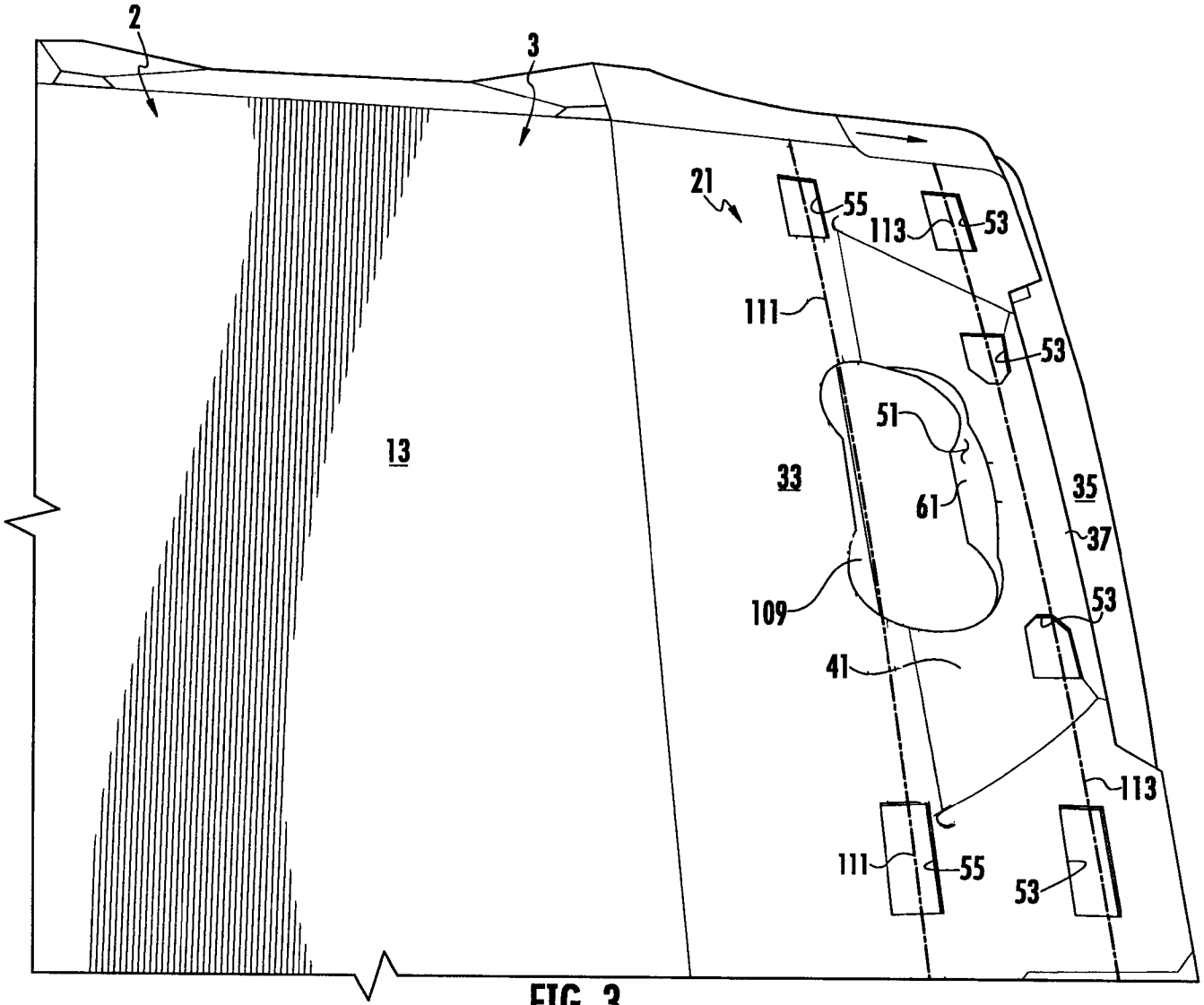
FIG. 3 is a view of a partially-formed reinforced handle of the blank of FIG. 1.
Figure 4:
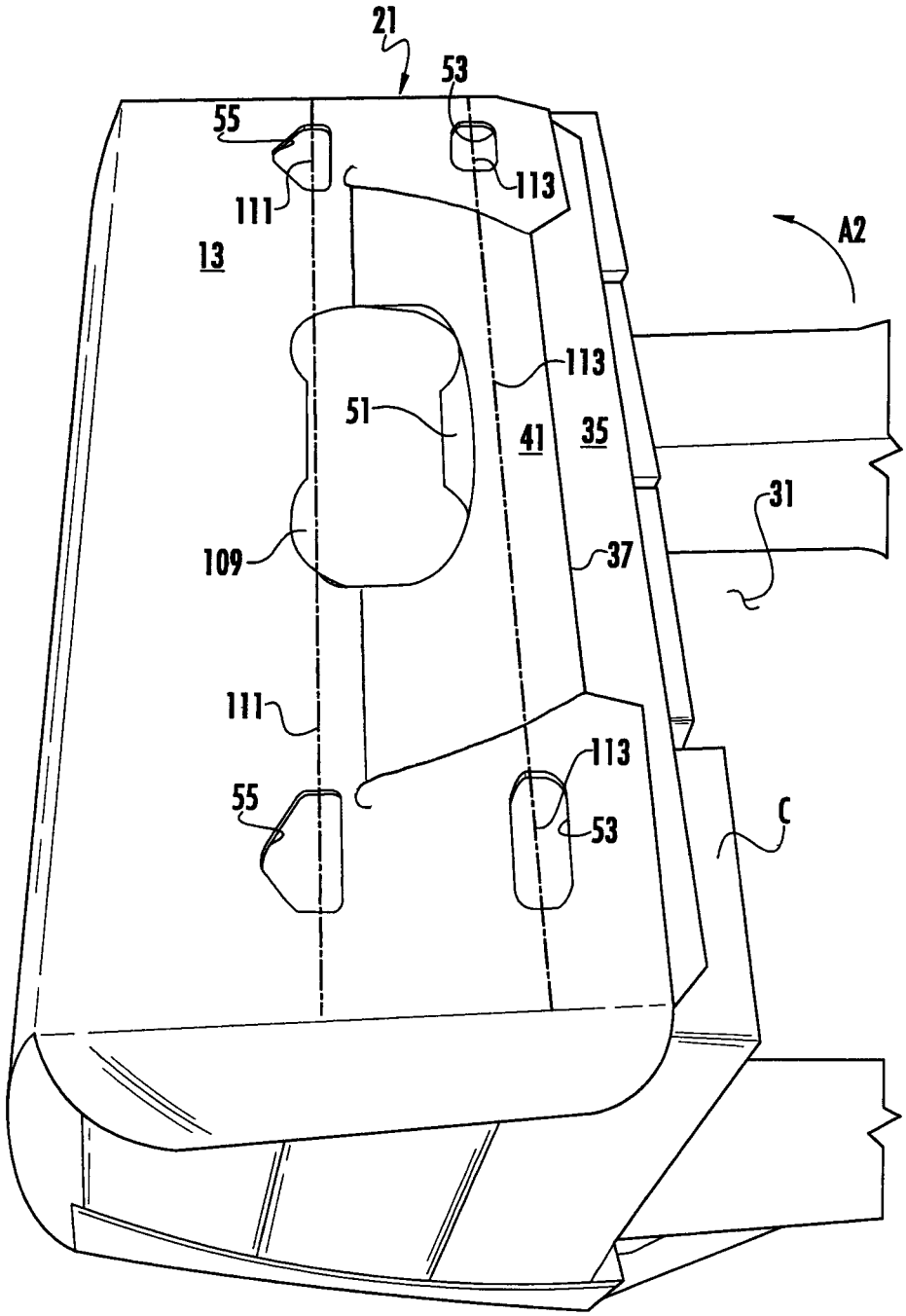
FIG. 4 is a perspective view of a partially-formed carton formed from the blank of FIG. 1.

FIGS. 2-9 show various views and features of one exemplary method of forming the blank 3 into the carton 5. The blank is first placed with the interior surface 105 facing up and containers C are placed on the bottom panel 11. Prior to or after placing the containers C on the bottom panel 11, the distal portion 35 of the first top panel 21 can be positioned relative to the main portion 33 as shown in FIGS. 2-3 to begin forming the reinforced handle 7. The distal portion 35 is positioned such that the second handle portion 61 is folded underneath the first handle portion 41 about the fold line 37 with the interior surface of the second handle portion being in face-to-face contact with the interior portion of the first handle portion (FIG. 3). The remaining portion of the distal portion 35 other than the second handle portion 61 is slid underneath the folded over second handle portion with the exterior surface of the remaining portion of the distal portion being in face-to-face contact with the exterior surface of the second handle portion (previously folded under the first handle portion 41) and interior surface of the main portion 33 of the first top panel 21. As shown in FIGS. 3-4, a leading edge portion 109 of the distal portion 35 that is formed by the cut 71 (shown in FIG. 1 as extending between portions of the second handle portion 61 in the blank 3) is inserted through the opening 51 adjacent the first handle portion 41. When the main portion 33 and distal portion 35 of the first top panel 21 are positioned as shown in FIGS. 3-4, glue 111, 113 or other adhesive can be applied as indicated. The glue 111 can be applied in a laterally extending line across openings 55, leading edge portion 109, and the exterior surface of the distal portion 35. The glue 113 can be applied in a laterally extending line across openings 53, the first handle portion 41 and the exterior surface of the main portion 31. The glue 111, 113 applied across the openings 53, 55 is applied to the distal portion 35 that is located below the openings. The glue 111, 113 could be otherwise applied in other shapes, and configuration other than a line, without departing from the disclosure.

In one embodiment, the leading edge portion 109 of the distal portion 35, or other features of the handle 7, can have engaging or locking features that engage one or more features or portions of the main portion 33 or other feature to allow the handle 7 to be formed without the need for glue or tape. In one embodiment, the folding of the distal portion 35 relative to the main portion 33 of the first top panel 21 from the position of FIG. 2 to the position of FIG. 3 can be a "Z-fold" with the handle portion 61 being folded relative to the handle portion 41 at fold line 37 and the distal portion 35 being moved or slid in the direction of arrow A1 so that the exterior surface of the distal portion generally fits below the interior surface of the main portion as the handle portion 61 folds under the handle portion 41. Alternatively, the leading edge portion 109 can be glued or taped to the underside of the main portion 33, rather than inserted through opening 51 without departing from the disclosure. Further, the handle 7 could be formed by other features or the features shown and described herein could be otherwise shaped, arranged, configured, and/or omitted without departing from the disclosure.

Figure 5:
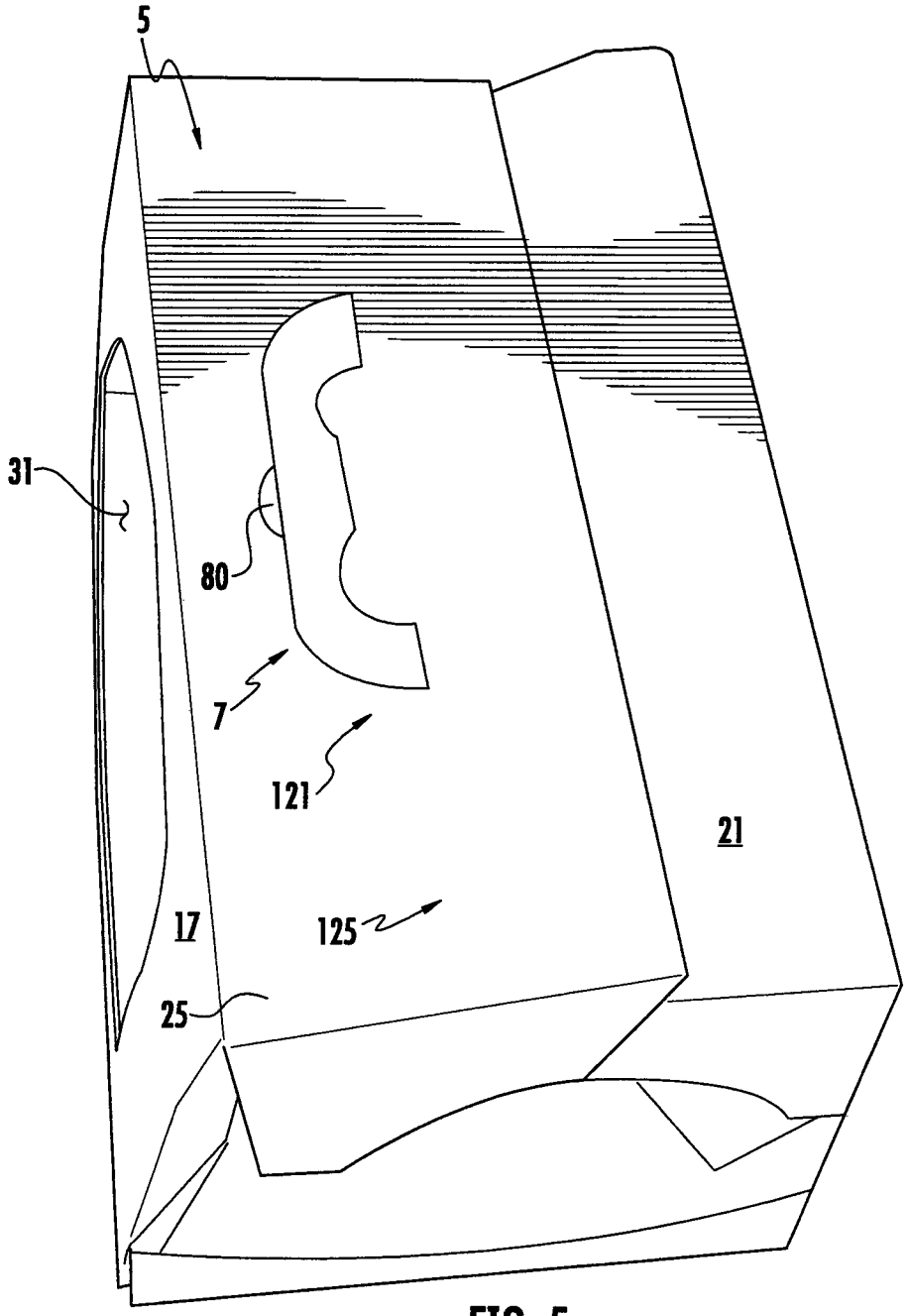
FIG. 5 is a perspective view of a carton formed from the blank of FIG. 1.
Figure 6:
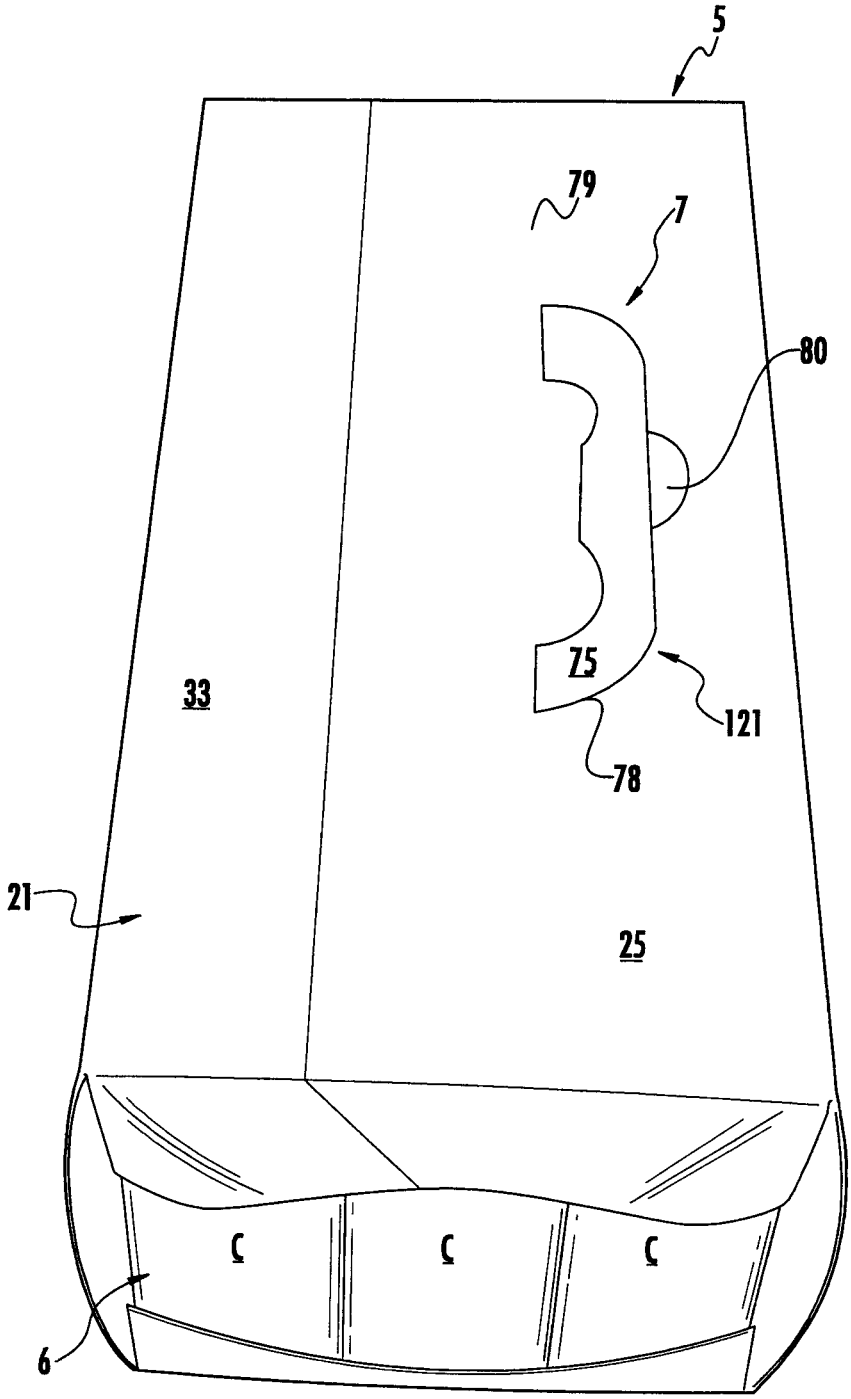
FIG. 6 is a perspective view of a carton formed from the blank of FIG. 1.
Figure 7:
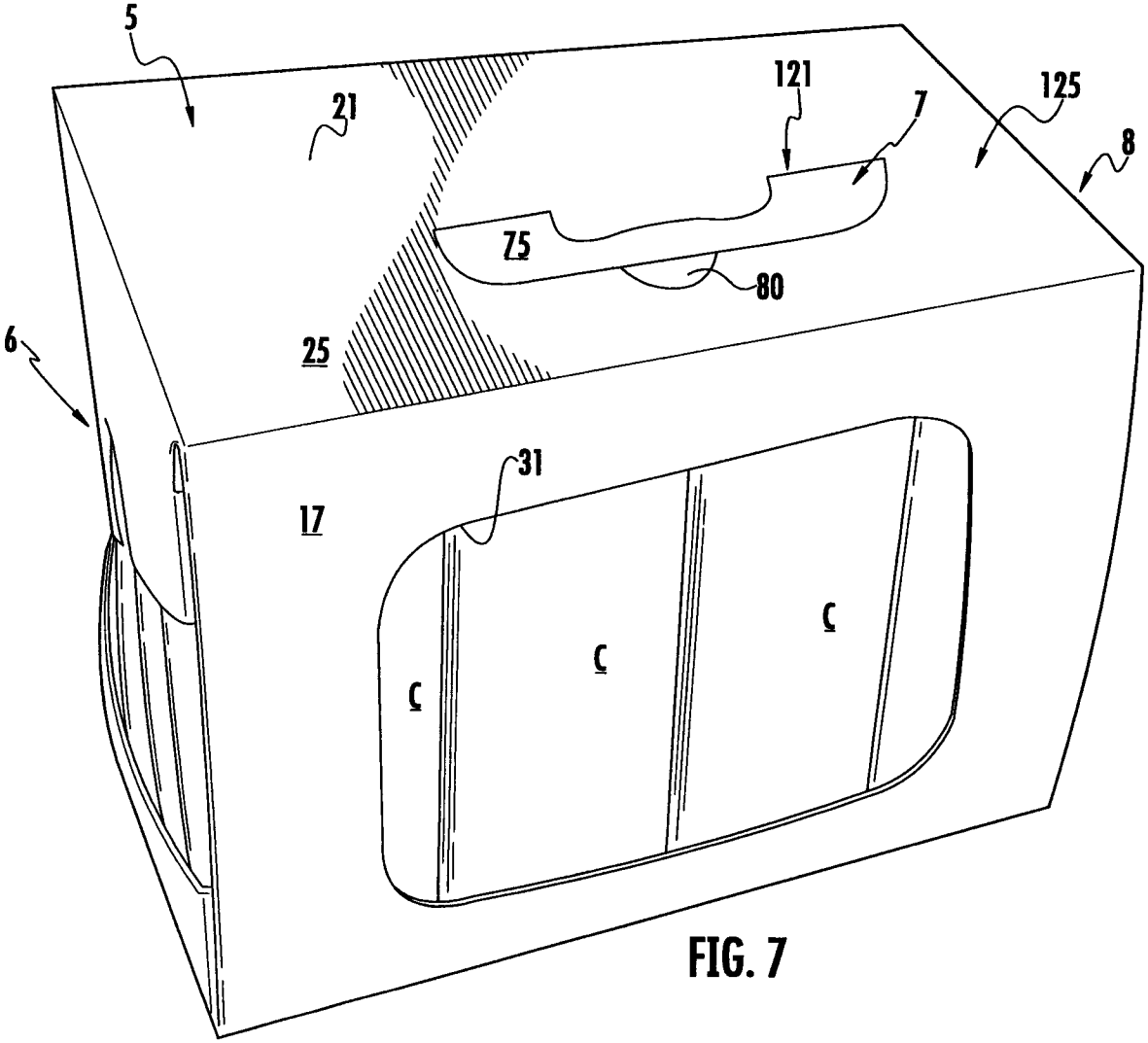
FIG. 7 is a perspective view of a carton formed from the blank of FIG. 1.

As shown in FIGS. 4-6, the blank 3 is further formed around the container C such that the second top panel 21, with the main portion 33 and distal portion 35, positioned as described above, contacts the tops of the containers. The second side panel 17 can be folded up against the containers in the direction of arrow A2 and the second top panel 25 positioned to overlap the first top panel 21 as shown in FIGS. 5 and 6. The third handle portion 75 overlaps the first handle portion 41 and is adhered to the first handle portion by the glue 113 applied to the first handle portion. Further, the second top panel 25 is secured to the folded under distal portion 35 through the openings 53, 55 in the main portion by the glue that is located in the openings 55. Also, the second top panel 35 is secured to the leading edge portion 109 by the glue 111 applied to the leading edge portion.

Figure 8:
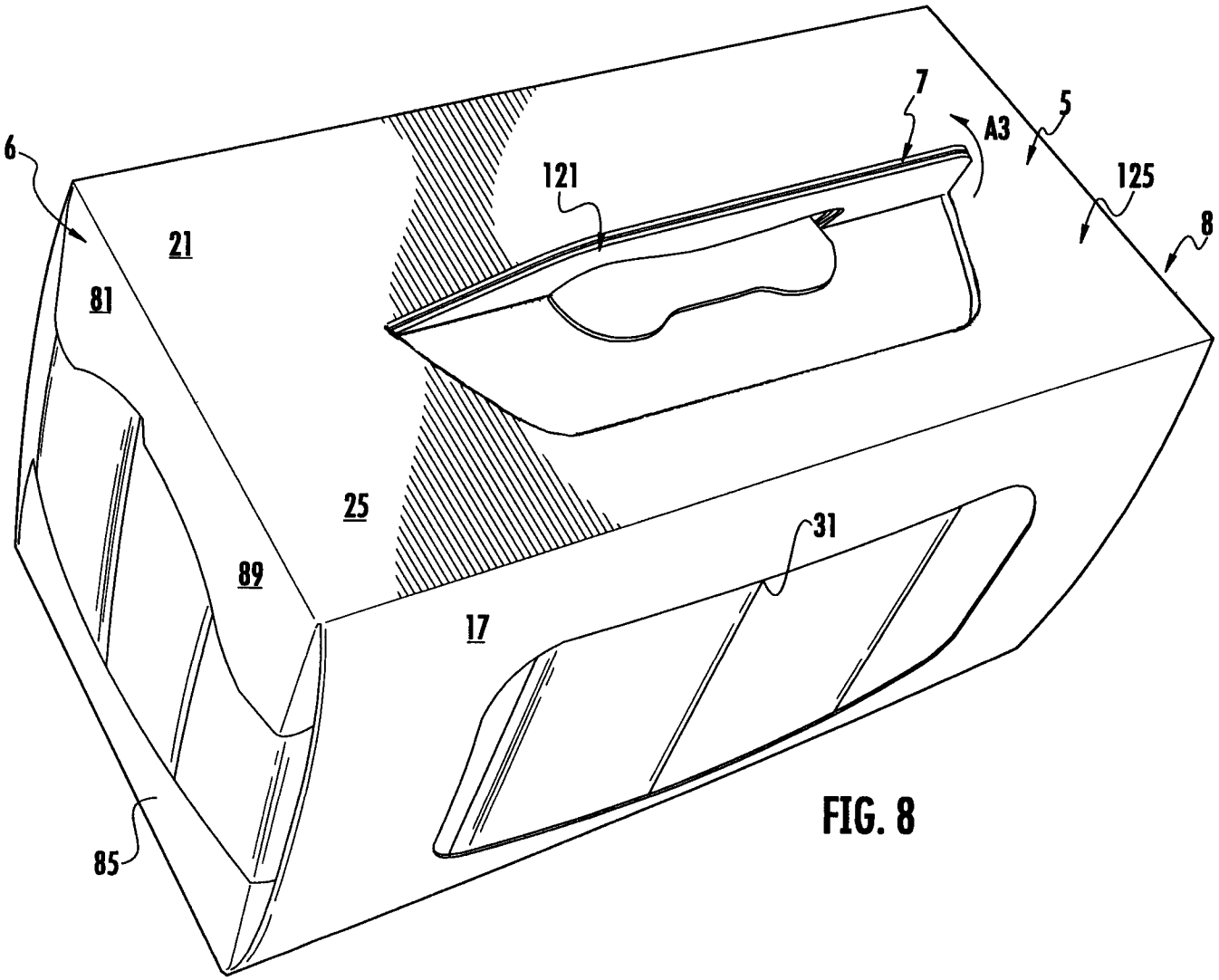
FIG. 8 is a perspective view of a carton with an activated handle formed from the blank of FIG. 1.
Figure 9:
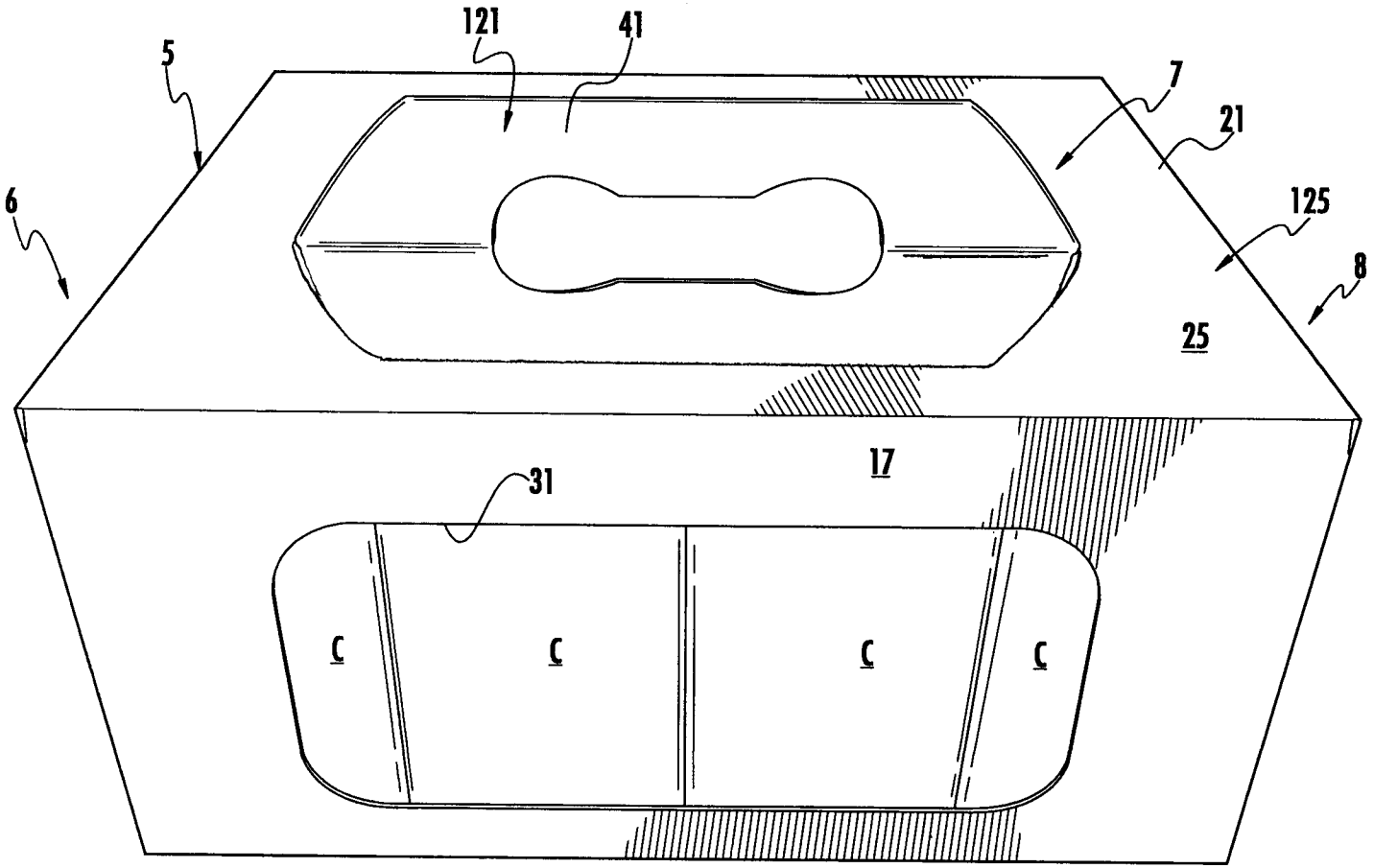
FIG. 9 is a perspective view of a carton with an activated handle formed from the blank of FIG. 1

The handle 7 of the carton 5 includes a reinforced handle portion 121 that is formed by the three handle portions 41, 61, 75 that are overlapped and adhered in the manner described above or an alternative method of forming. The reinforced handle portion 121 can be grasped at the opening 80 and lifted in the direction of arrow A3 by tearing along tear lines 47, 49, and 78, 79 to separate the reinforced handle portion from the first top panel 21 and second top panel 25, as shown in FIG. 8. The carton 5 includes a reinforced top panel 125 that is formed by the overlapping and adhering of the three layers of material (e.g., the distal portion 35 of the first top panel 21, the main portion 33 of the first top panel, and the second top panel 25).

The first end 6 of the carton can be at least partially closed by positioning the first end flaps 81, 83, 85, 87, 89 and the second end 8 of the carton can be at least partially closed by positioning the second end flaps 91, 93, 95, 97, 99. In alternative embodiments, the ends 6, 8 can be fully open or fully closed without departing from the disclosure.

Figure 10:
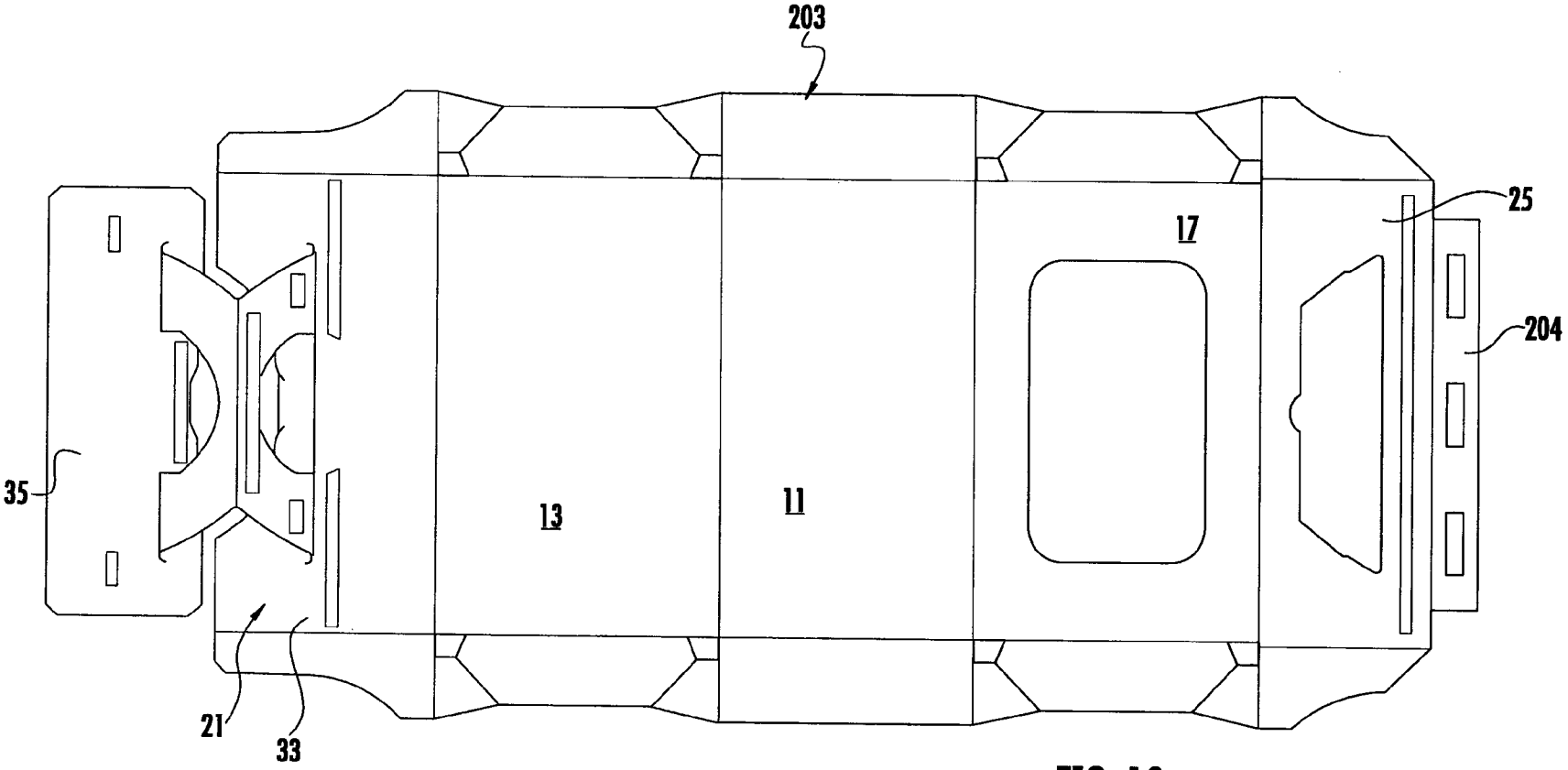
FIG. 10 plan view of exterior surface of a blank of a second embodiment.

FIG. 10 shows a blank 203 of a second embodiment of the disclosure having similar features as the first embodiment. Accordingly, similar or identical features of the embodiments are provided with identical or similar reference numbers. The blank 203 includes a glue flap 204 foldably attached to the second top panel 25 that is for adding strength to a carton formed from the blank 203 and for preventing tearing of the handle from respective corners of the carton formed from the blank 203.

Figure 11:
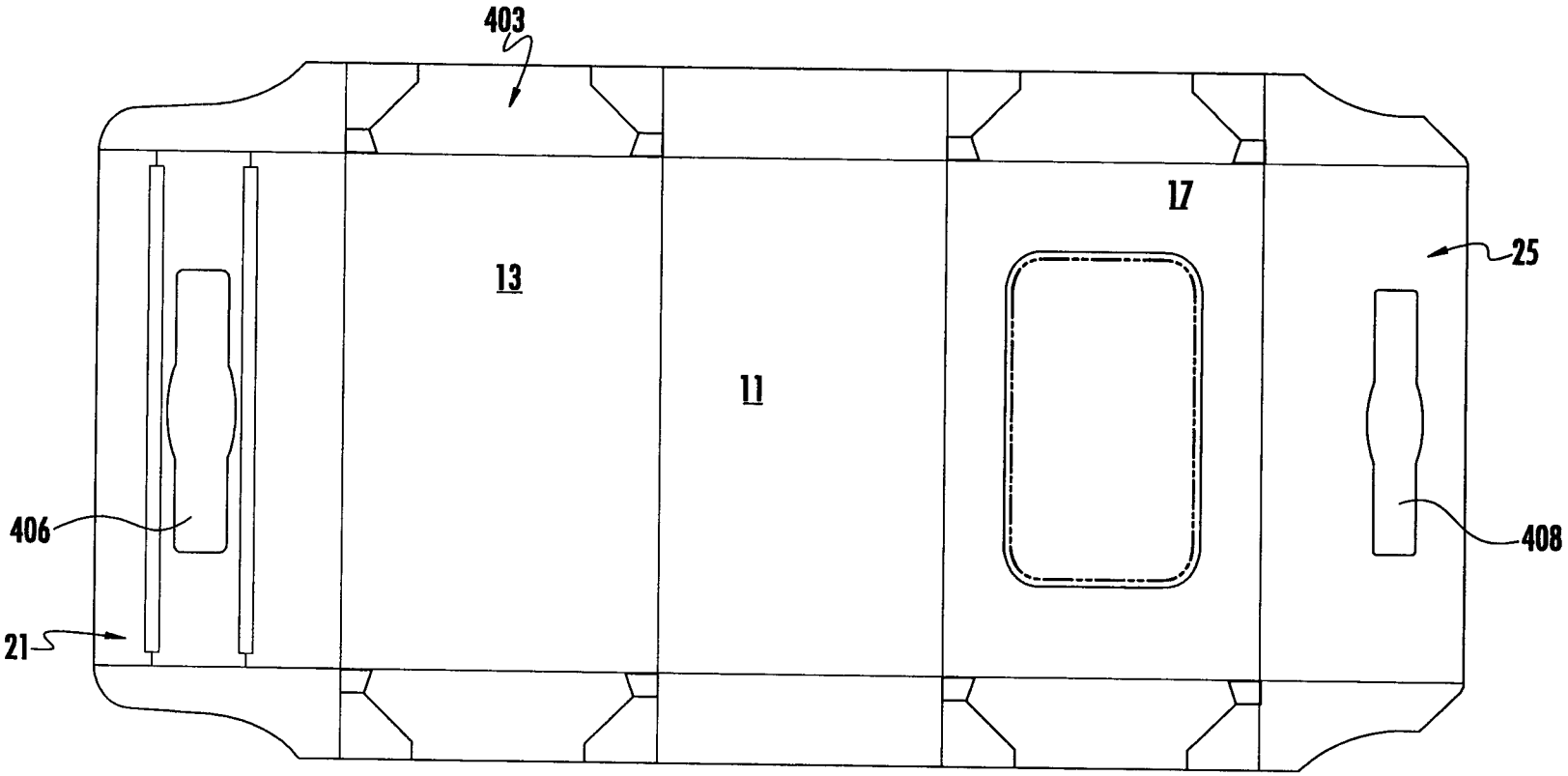
FIG. 11 plan view of exterior surface of a blank of a third embodiment.

FIG. 11 shows a blank 403 of a third embodiment of the disclosure having similar features as the first embodiment. Accordingly, similar or identical features of the embodiments are provided with identical or similar reference numbers. The blank 403 includes a handle portion 406 in the first top panel 21 and a handle portion 408 in the second top panel 25 for forming the handle of the carton.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for carrying a plurality of articles, comprising:

a plurality of panels extending at least partially around an interior of the carton, the plurality of panels comprises at least a first top panel, a second top panel, at least one side panel, and a bottom panel, the first top panel and the second top panel being at least partially overlapped, at least one of the first top panel and the second top panel comprises a main portion foldably connected to the at least one side panel and a distal portion foldably connected to the main portion, the main portion having a first handle portion and the distal portion having a second handle portion, the distal portion having an exterior surface at least partially in face-to-face contact with the interior surface of the main portion; and a handle comprising at least the first handle portion and the second handle portion, the distal portion comprises a leading edge portion and the main portion comprises a handle opening adjacent the first handle portion; the leading edge portion is inserted through the handle opening.

2. The carton of claim 1 wherein the first handle portion is foldably connected to the second handle portion.

3. The carton of claim 2 wherein the interior surface of the first handle portion is in face-to-face contact with at least a portion of the interior surface of the second handle portion.

4. The carton of claim 1 wherein the main portion is in the first top panel and has at least one opening, the second top panel being adhesively attached to the distal portion of the first top panel by way of the opening.

5. The carton of claim 4 wherein adhesive applied to one of the distal portion and the second top panel is in contact with the distal portion and the second top panel through the opening.

6. The carton of claim 1 wherein the second top panel comprises a third handle portion, the first handle portion, the second handle portion, and the third handle portion comprising three plies of material that form the handle.

7. The carton of claim 6 wherein the third handle portion is in face-to-face contact with at least a portion of the first handle portion.

8. The carton of claim 7 wherein the first handle portion has at least one opening, the third handle portion being adhesively attached to the second handle portion by way of the opening.

9. The carton of claim 8 wherein adhesive applied to one of the second handle portion and the third handle portion is in contact with the second handle portion and the third handle portion through the opening.

10. The carton of claim 1 wherein the leading edge portion overlaps at least a portion of the main portion, the leading edge portion being in face-to-face contact with the main portion and at least a portion of one of the first top panel and the second top panel to form a reinforced handle portion.

11. The carton of claim 1 further comprising a plurality of end flaps foldably connected to a respective panel of the plurality of panels, the end flaps are configured to at least partially close at least one end of the carton.

12. The carton of claim 11 wherein the plurality of end flaps comprises gusseted end flaps configured to provide gusset corners of the carton.

13. The carton of claim 1 further comprising:

a display opening in the at least one side panel, the display opening allowing viewing of at least one article of the plurality of articles.

14. The carton of claim 1 wherein the second top panel comprises an opening, the opening being for accessing the handle.

15. A carton for carrying a plurality of articles, comprising:

a plurality of panels extending at least partially around an interior of the carton, the plurality of panels comprises at least a first top panel, a second top panel, at least one side panel, and a bottom panel, the first top panel and the second top panel being at least partially overlapped, at least one of the first top panel and the second top panel comprises a main portion foldably connected to the at least one side panel and a distal portion foldably connected to the main portion, the main portion having a first handle portion and the distal portion having a second handle portion, the distal portion having an exterior surface at least partially in face-to-face contact with the interior surface of the main portion; and a handle comprising at least the first handle portion and the second handle portion; and the second top panel comprises an adhesive flap, the adhesive flap comprises two plies of material at a distal edge of the second top panel and is in face-to-face contact with the distal portion of the first top panel.

16. A blank for forming a carton for carrying a plurality of articles, the blank comprising:

a plurality of panels comprising at least a first top panel, a second top panel, at least one side panel, and a bottom panel, the first top panel and the second top panel configured to be at least partially overlapped, at least one of the first top panel and the second top panel comprises a main portion foldably connected to the at least one side panel and a distal portion foldably connected to the main portion, the main portion having a first handle portion and the distal portion having a second handle portion, the distal portion having an exterior surface configured to be at least partially in face-to-face contact with the interior surface of the main portion; and features for forming a handle comprising at least the first handle portion and the second handle portion, the distal portion comprises a leading edge portion and the main portion comprises a handle opening adjacent the first handle portion, the leading edge portion configured to be inserted through the handle opening.

17. The blank of claim 16 wherein the first handle portion is foldably connected to the second handle portion.

18. The blank of claim 17 wherein the interior surface of the first handle portion is configured to be in face-to-face contact with at least a portion of the interior surface of the second handle portion.

19. The blank of claim 16 wherein the main portion is in the first top panel and has at least one opening configured to receive adhesive.

20. The blank of claim 16 wherein the second top panel comprises a third handle portion, the first handle portion, the second handle portion, and the third handle portion comprising three plies of material for forming the handle.

21. The blank of claim 20 wherein the third handle portion is configured to be in face-to-face contact with at least a portion of the first handle portion.

22. The blank of claim 21 wherein the first handle portion has at least one opening configured to receive adhesive.

23. The blank of claim 16 further comprising a plurality of end flaps foldably connected to a respective panel of the plurality of panels, the end flaps are configured to at least partially close at least one end of the carton.

24. The blank of claim 23 wherein the plurality of end flaps comprises gusseted end flaps configured to provide gusset corners of the carton.

25. The blank of claim 16 further comprising:

a display opening in the at least one side panel, the display opening allowing viewing of at least one article of the plurality of articles.

26. The blank of claim 16 wherein the second top panel comprises an opening, the opening being for accessing the handle.

27. A method of forming a carton for carrying a plurality of articles, the method comprising:

obtaining a blank comprising a plurality of panels comprising at least a first top panel, a second top panel, at least one side panel, and a bottom panel, the first top panel and the second top panel configured to be at least partially overlapped, at least one of the first top panel and the second top panel comprises a main portion foldably connected to the at least one side panel and a distal portion foldably connected to the main portion, the main portion having a first handle portion and the distal portion having a second handle portion, the distal portion having an exterior surface configured to be at least partially in face-to-face contact with the interior surface of the main portion, and features for forming a handle comprising at least the first handle portion and the second handle portion, and the distal portion comprises a leading edge portion and the main portion comprises a handle opening adjacent the first handle portion;

forming at least a portion of an interior of the carton by folding the plurality of panels about the plurality of articles; and forming the handle by positioning the distal portion so that the exterior surface of the distal portion is in face-to-face contact with the interior surface of the main portion, the positioning the distal portion comprises positioning the first handle portion relative to the second handle portion to form the handle and inserting the leading edge portion through the handle opening.

28. The method of claim 27 wherein the first handle portion is foldably connected to the second handle portion and the forming the handle comprises positioning the interior surface of the first handle portion in face-to-face contact with at least a portion of the interior surface of the second handle portion.

29. The method of claim 27 wherein the main portion of the first top panel has at least one opening, the forming the handle comprises adhesively attaching the second top panel and the distal portion of the first top panel by way of the opening.

30. The method of claim 29 wherein the forming the handle comprises applying adhesive to one of the distal portion and the second top panel so that the adhesive is in contact with the distal portion and the second top panel through the opening.

31. The method of claim 27 wherein the second top panel comprises a third handle portion, the forming the handle comprises positioning the first handle portion, the second handle portion, and the third handle portion comprising to form three plies of material that form the handle.

32. The method of claim 31 wherein the forming the handle comprises positioning the third handle portion to be in face-to-face contact with at least a portion of the first handle portion.

33. The method of claim 31 wherein the first handle portion has at least one opening, the forming the handle comprises adhesively attaching the third handle portion to the second handle portion by way of the opening.

34. The method of claim 33 wherein the forming the handle comprises applying adhesive to one of the second handle portion and the third handle portion so that the adhesive is in contact with the second handle portion and the third handle portion through the opening.

35. The method of claim 27 wherein the forming the handle comprises forming a reinforced handle portion by placing the leading edge portion to overlap at least a portion of the main portion and by placing the leading edge portion in face-to-face contact with the main portion and at least a portion of one of the first top panel and the second top panel.

* * * * *